US006554639B2

(12) United States Patent
Doriski, Jr.

(10) Patent No.: US 6,554,639 B2
(45) Date of Patent: Apr. 29, 2003

(54) WIRING INTERFACE

(75) Inventor: John Doriski, Jr., Enumclaw, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/969,697

(22) Filed: Oct. 2, 2001

(65) Prior Publication Data

US 2002/0013087 A1 Jan. 31, 2002

Related U.S. Application Data

(63) Continuation of application No. 09/358,115, filed on Jul. 21, 1999, which is a continuation-in-part of application No. 08/721,415, filed on Sep. 26, 1996, now abandoned, which is a continuation-in-part of application No. 08/392,643, filed on Feb. 21, 1995, now abandoned, which is a continuation-in-part of application No. 08/205,907, filed on Mar. 2, 1994, now abandoned.

(51) Int. Cl.[7] ..... H01R 12/24
(52) U.S. Cl. ..... 439/498; 439/505
(58) Field of Search ..... 439/498, 540.1, 439/505

(56) References Cited

U.S. PATENT DOCUMENTS 4,674,819 A * 6/1987 Fujitani et al.
5,044,964 A * 9/1991 Minerd et al. ..... 439/67

* cited by examiner

*Primary Examiner*—Gary Paumen
(74) *Attorney, Agent, or Firm*—Conrad O. Gardner

(57) ABSTRACT

A plural level system to achieve simplicity in wiring connections in an electronics bay. The system involves the assigning of wire separation categories for panel connections and incorporates one or more separation dedicated connectors for each category and connects these via integration wire bundles and proper terminals of integration disconnects on the opposite end of the system.

4 Claims, 11 Drawing Sheets

TYPICAL INTEGRATION DISCONNECT

WIRING INTERFACE

CROSS-REFERENCE TO RELATED APPLICATIONS

This application is a continuation of application Ser. No. 09/358,115, abandoned, which is a continuation-in-part of Ser. No. 09/010,392, abandoned, which is a continuation-in-part of prior copending application Ser. No. 08/721,415, filed Sep. 26, 1996, abandoned, which is a continuation-in-part of application Ser. No. 08/392,643, filed Feb. 21, 1995, abandoned, which is a continuation-in-part of application Ser. No. 08/205,907, filed Mar. 2, 1994, abandoned.

BACKGROUND OF THE INVENTION

1. Field of the Invention

The present invention relates to wiring installations and more particularly to wiring installations in aircraft electronics bays, main instrument panels or overhead panels which require extremely complex wiring of multiple systems.

2. Description of the Prior Art

In the patent literature U.S. Pat. No. 4,583,215 to Hargrave, et al. shows a telephone line access system for main distribution frame that employs access blocks comprising sockets and pins for coupling two rows of lightning protectors. One or more integrated circuit modules are attached to each access block and these may be readily affixed to and disconnected from a main distribution frame.

U.S. Pat. No. 4,320,261 to Scerbo et al. shows a method for optimizing cable routing in the distribution panels for an office environment. Means are described for minimizing crossovers and cable lengths. Optimization is based on crossovers and length in contrast to the present method which considers separation requirements. Also Scerbo, et al. is hardwired in contrast to the present method of using connectors.

U.S. Pat. No. 4,972,298 to Casa et al. is illustrative of high density circuit computer assemblies, while U.S. Pat. No. 2,098,321 to Treptow is illustrative of distributing frames in telephone systems.

U.S. Pat. No. 4,674,819 to Fujitani et al. shows an electric wire branching device used for forming branching circuits in a wire harness (bundle) system.

U.S. Pat. No. 5,044,964 to Minerd et al. shows a method of controlling DC devices on a serial data bus by providing a programmable connector module which eliminates the massive amounts of interconnective wiring in conventional electromechanical driven systems for controlling a machine.

The problems of wiring separation, congestion, integration, routing, cross-connected wire bundles, and disconnects in aircraft installations have been tolerated and accepted without solution, the traditional method of complex wiring of multiple systems being to hand wire from a connector at the peripheral device to another at e.g., an overhead panel or directly into the overhead panel. There has been no consistent system for achieving wire separation, avoiding cross-connects or minimizing connections or any attempts made to solve the congestion problem during aircraft final assembly.

BRIEF SUMMARY OF THE INVENTION

This invention employs a plural-level system to achieve simplicity. Each panel is analyzed to assign wire separation categories for every required connection, then one or more connectors (designated separation dedicated connectors) are incorporated for each category. The opposite end of the system is composed of a set of "integration disconnects". The connections on these are determined by performing a wire separation category analysis on the wires coming into the instrument bay from the peripherals in a given physical area (called a destination area) and assigning at least one connector for each category. The third portion of the system is composed of the "integration wire bundles". These are designed with breakouts from the bundle body so that they connect the proper terminals of the dedicated separation connectors to the proper terminals of the integration disconnects. In addition to the above advantages, the present invention importantly practically eliminates the need for doing hand wiring at final assembly. The features, objects and advantages of the present invention will be apparent hereinafter from a detailed description of the invention and the appended claims taken in conjunction with the attached drawing of a preferred embodiment.

BRIEF DESCRIPTION OF THE SEVERAL VIEWS OF THE DRAWING

FIGS. 2B and 2C are taken together on an enlarged view of the system of

FIG. 2A.

DETAILED DESCRIPTION OF THE INVENTION

Figure 1:
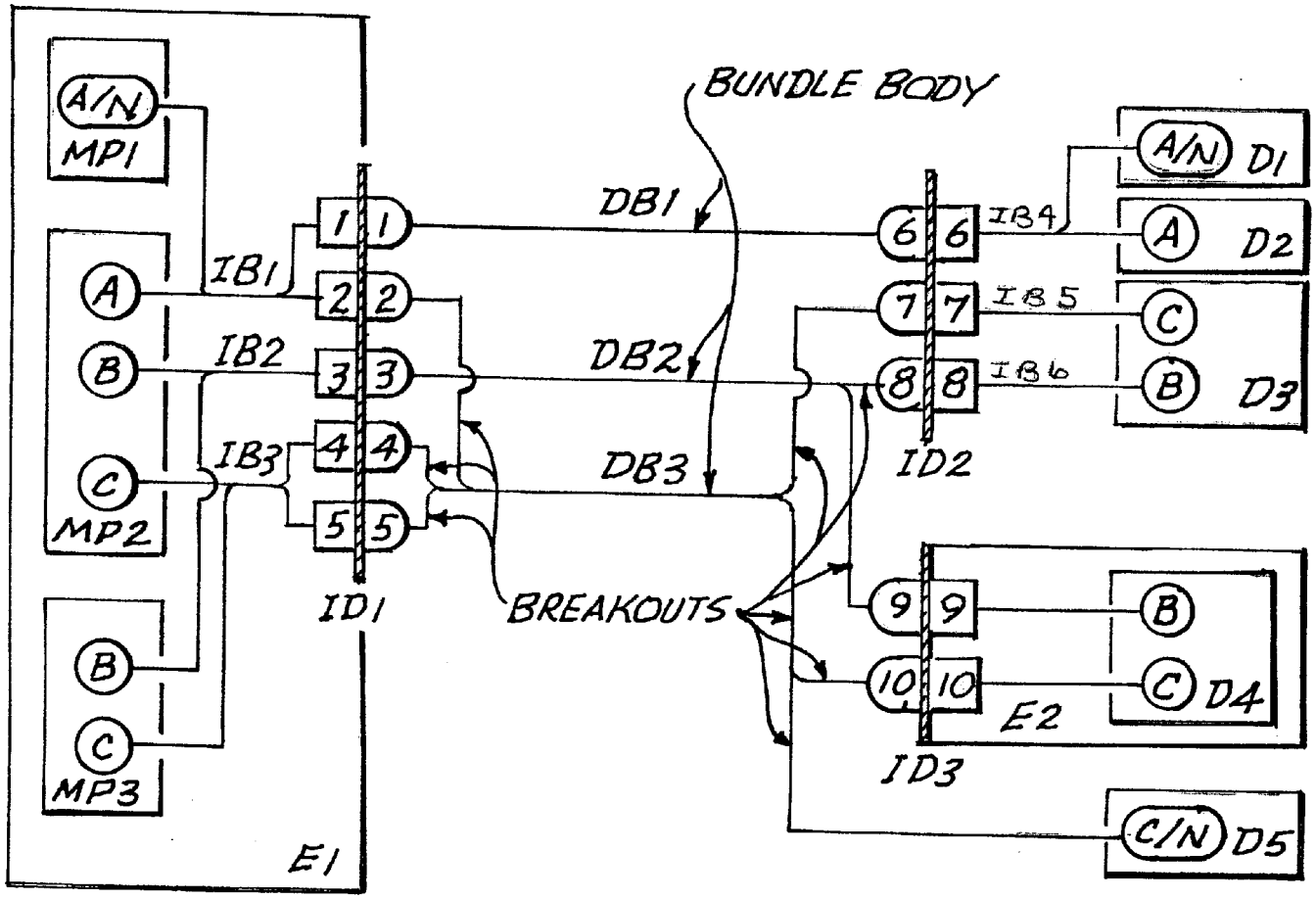
FIG. 1 is a schematic block diagram of the present basic plural level wiring interface.
Figure 3A:
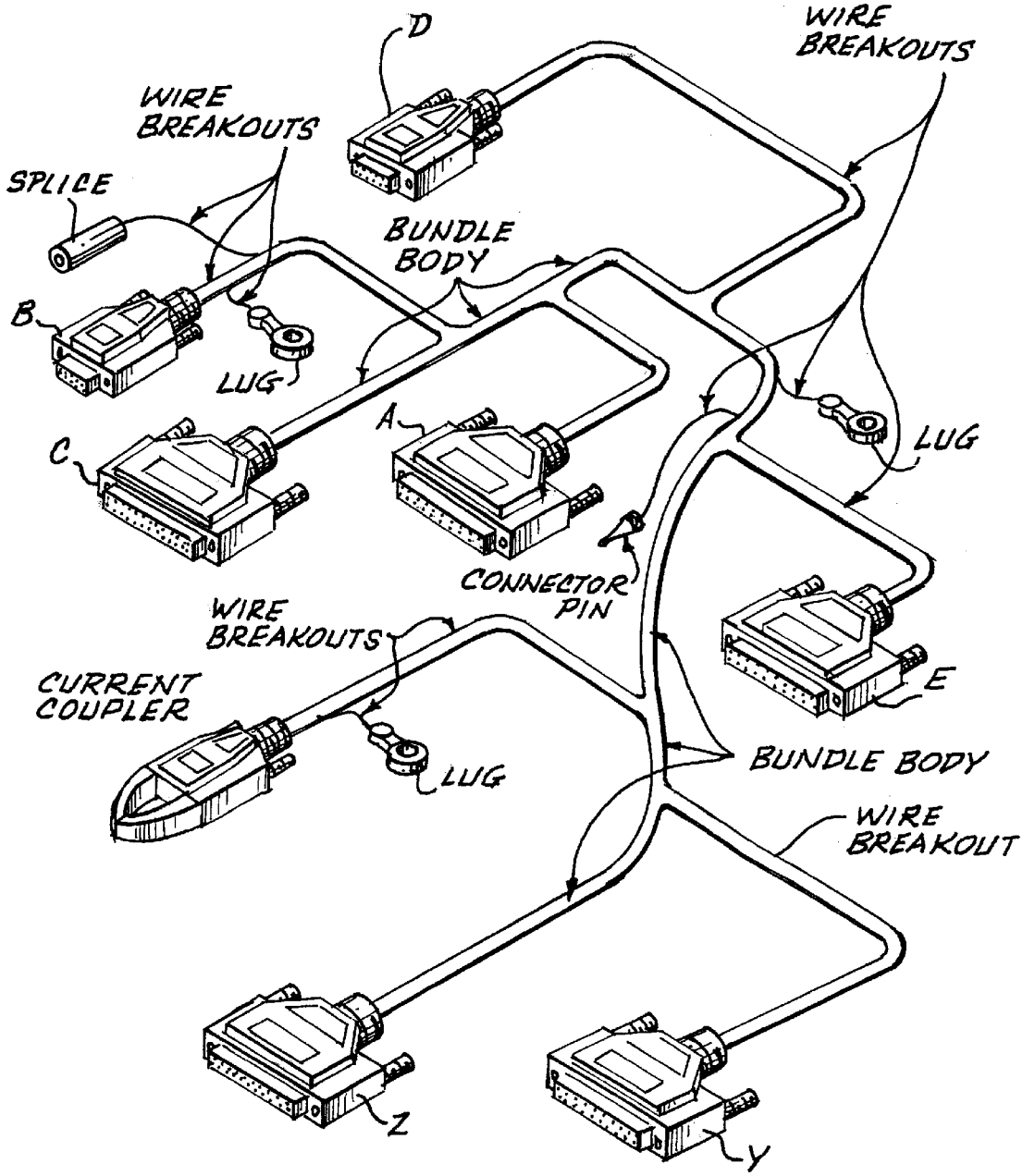
FIGS. 3A, 3B, 3C and 3D are an exemplary representation of the structure of a typical integration or distribution bundle.
Figure 3B:
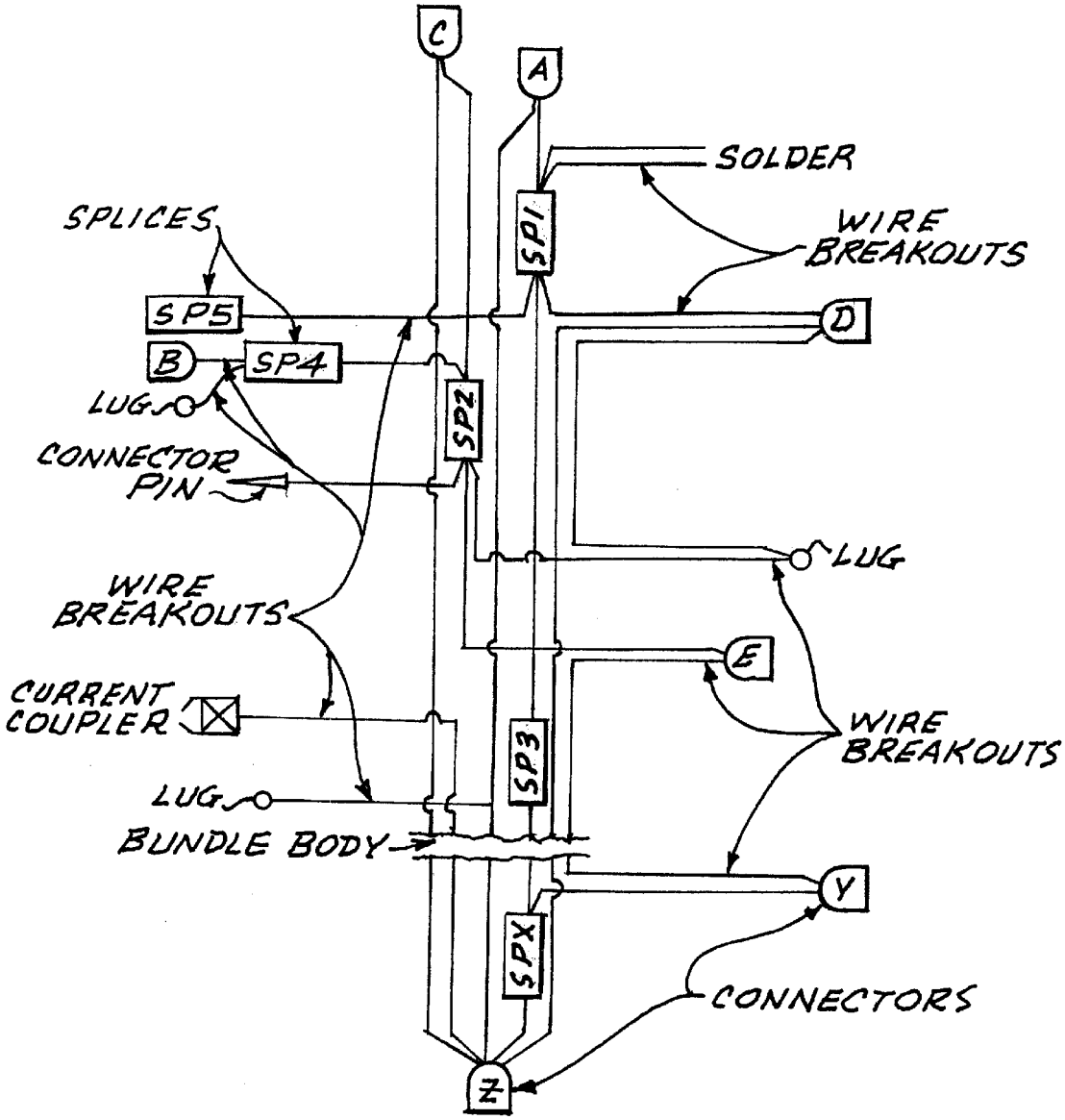
Figure 4A:
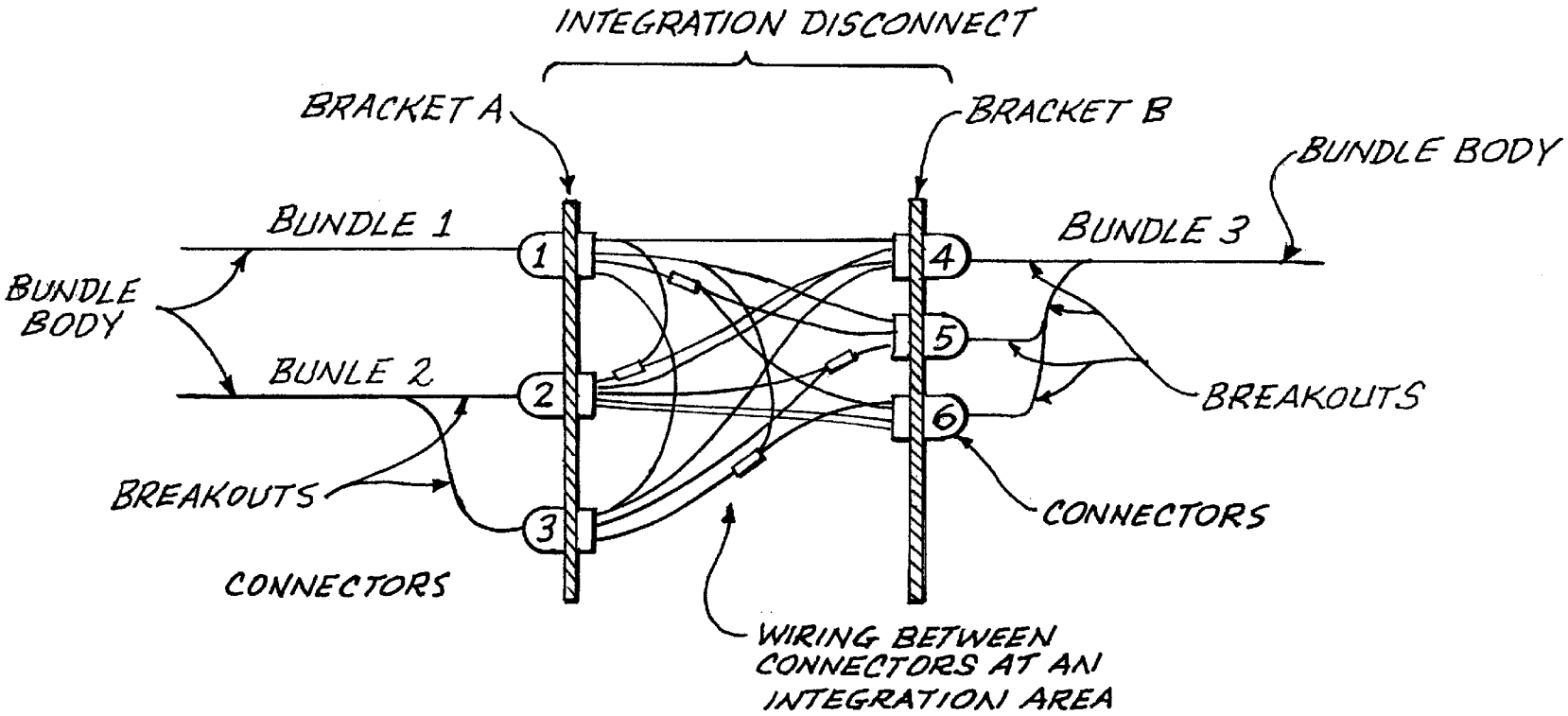
FIGS. 4A and 4B show examples of Integration Disconnects with and without wiring.
Figure 4B:
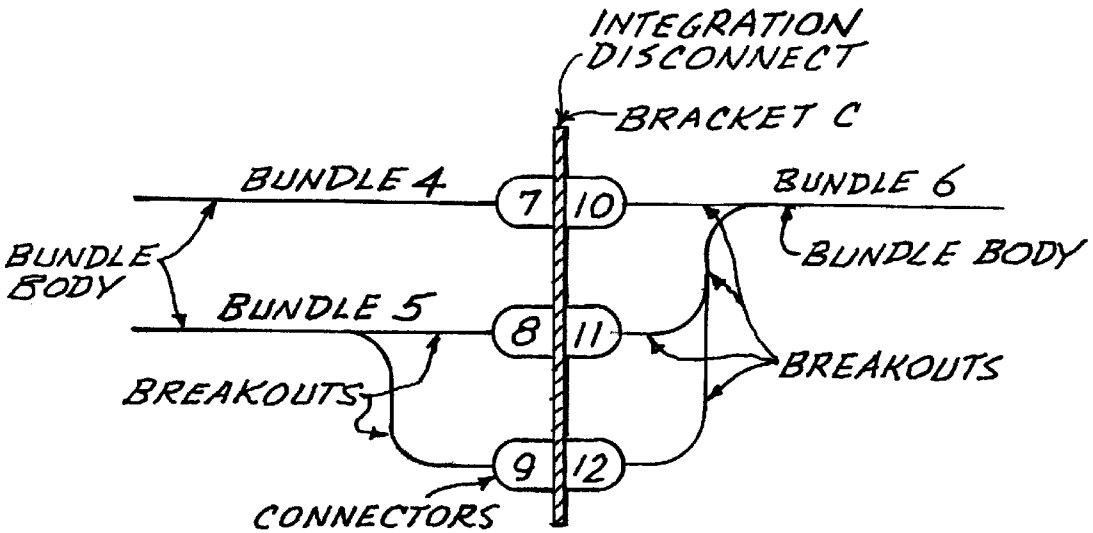
Figure 4C:
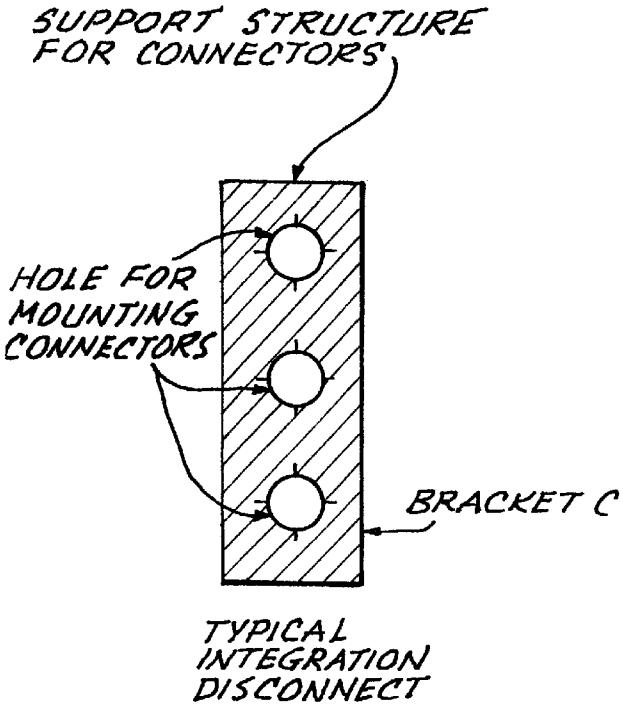
FIG. 4C shows a typical Integration Disconnect.
Figure 4D:
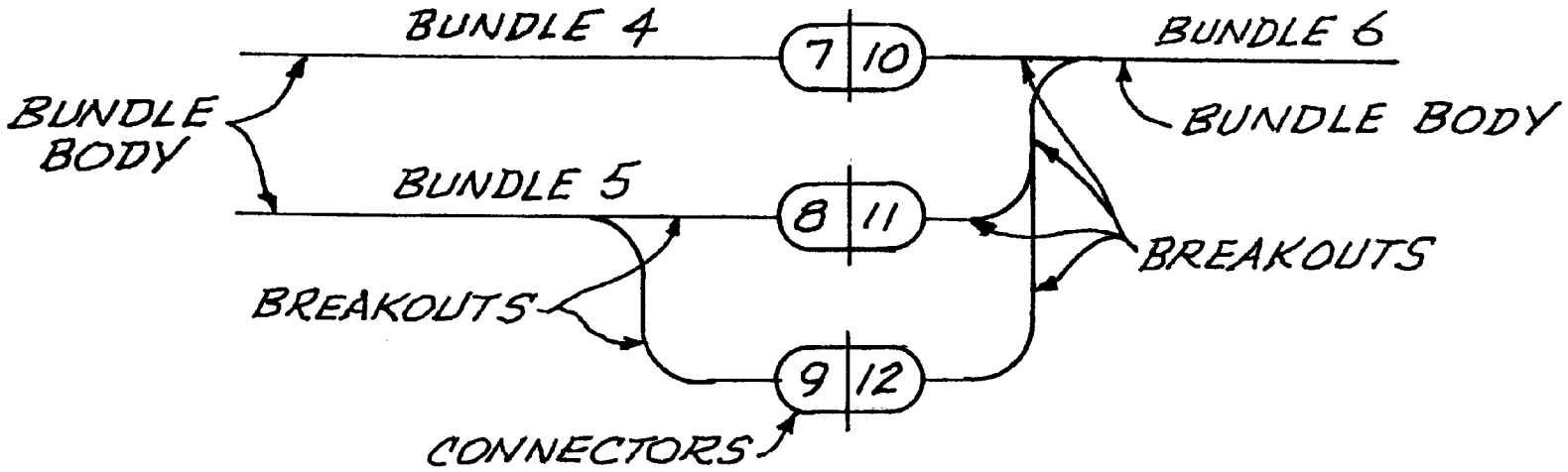
FIG. 4D shows an example of integrating connectors without an Integration Disconnect bracket.

Initially upon reviewing the aircraft overhead panel or electronics bay of an aircraft, and due to its inherent wire congestion, complexity, and separation problems, efforts towards a solution of the problem have generally not been attempted or abandoned. The present invention however solves the separation problem by utilizing separation dedicated connectors. Using this method a wire is inserted into the connector meeting the wire's separation requirement; should multiple connectors meet the wire's separation requirement, the wire is inserted into the connector also meeting the wire's destination requirements, thereby providing a solution to the separation routing congestion, cross-connected wire bundles, and complexity problems. A wiring matrix results in simplified discrete integrated wire bundles which are assembled and positioned on the module or overhead panel before final assembly, thereby completing a module or panel and wiring assembly. Routing integration previously achieved by end point aircraft final assembly wiring with complex integration wiring panels is eliminated in accordance with the present plural level wiring interface hereinafter described utilization which is a system utilizing separation dedicated connectors, integration disconnects (having no wiring, Ref. FIGS. 4A, 4B and 4D), Ref. FIG. 1 and FIG. 2, modular integrated wire bundle breakouts from the bundle body (Ref. FIGS. 1, 3A and 3B). This system permits wire bundle production on foam boards including connectors and wiring as integral unitary modules.

Concern has been expressed with regard to the problem of cross-connected wire bundles at a connector (wiring more than one wire bundle to a single connector). This concern is expressed primarily due to production, installation and separation problems. The cross-connection problem is herein solved by the utilization of separation dedicated connectors on modules and panels.

Turning now to FIG. 1, a plural level wiring interface system is shown in which the following symbols are representative of the interface components:

MP1, MP2, MP3 are modules or panels

ID1, ID2, ID3 are integration disconnects

IB1, IB2, IB3 are integration wire bundles

DB1, DB2, DB3 are distribution wire bundles

D1, D2, D3, D4, D5 are destination devices

E1, E2 are assemblies

A,B,C,N are dedicated separation categories at connectors

1,2,3,4,5,6,7,8,9,10 are connectors

In the following, the method by which wiring interfaces are defined and developed will be described:

As shown in FIG. 1; starting with the most complex module or panel integration assembly, the separation categories in the module or panel are determined; A,B,C and N for example, where N is a neutral or non-critical separation; and for example, Separation A is routed on the left side, B is routed on the right side, and C is redundant to A and/or B and routed away from A and B. The module or panel is assigned a connector for each separation category in the module or panel.

As shown in FIG. 1; MP2 is assigned separation connectors A,B,C; MP3 is assigned separation connectors B and C; and MP1 is assigned separation connector A/N (since separation category N may be combined with any other separation category). The internal wiring of the modules or panels are separation routed and connected to the separation dedicated connectors (Ref. Definition) of the module or panel interface. Integration wire bundles IB1, IB2, IB3 are used to route wires of similar separation from the module or panel separation dedicated connector interface to an integration disconnect ID1 via breakouts from the bundle body. Wires from separation dedicated connectors; A of MP2 and A/N of MP1 are combined into IB1; B of MP2 and MP3 are combined into EB2; and C of MP2 and MP3 are combined into IB3. Integration wire bundles IB1, IB2, and IB3 are kept separate from each other and routed to an integration disconnect ID1. (Thus a failure in one bundle will not affect the wiring in another bundle.) This integration disconnect is close to or part of the module or panel assembly E1. The integration disconnect provides a disconnect for the assembly E1 as well as an integration interface to the distribution wire bundles. IB1 mates with connector 1 (separation dedicated A/N) and connector 2 (separation dedicated N); [Note: The integration disconnect connector 2 is used to route a portion of the separation N wires based on destination, and eliminates the need for wiring at the integration disconnect (Ref. Definition) to enter another distribution wire bundle, (Ref. FIGS. 4A, 4B and 4D). IB2 mates directly with DB2 and provides a disconnect function at connector 3. IB3 mates with connectors 4 and 5 to accommodate the volume of wires and provide the disconnect function. The distribution wire bundles are used to make long runs with breakouts from the bundle body (Ref. FIG. 1) to other integration or destination areas. (DB1, DB2, and DB3 are distribution bundles.) DB1 routes separation category A wires direct from ID1 to ID2; (integration disconnect, ID2, is shown being used as a production break interface). DB2 routes separation category B wires to both ID2 and ID3 (ID3 being shown as an integration disconnect interface on an enclosed assembly E2). DB3 accepts separation category N wires from IB1 for routing to destination device D5 having a single C/N separation dedicated connector; DB3 also has routing breakouts from the bundle body (Ref. FIG. 1) for separation category C wiring to ID2 and ID3.

Figure 2A:
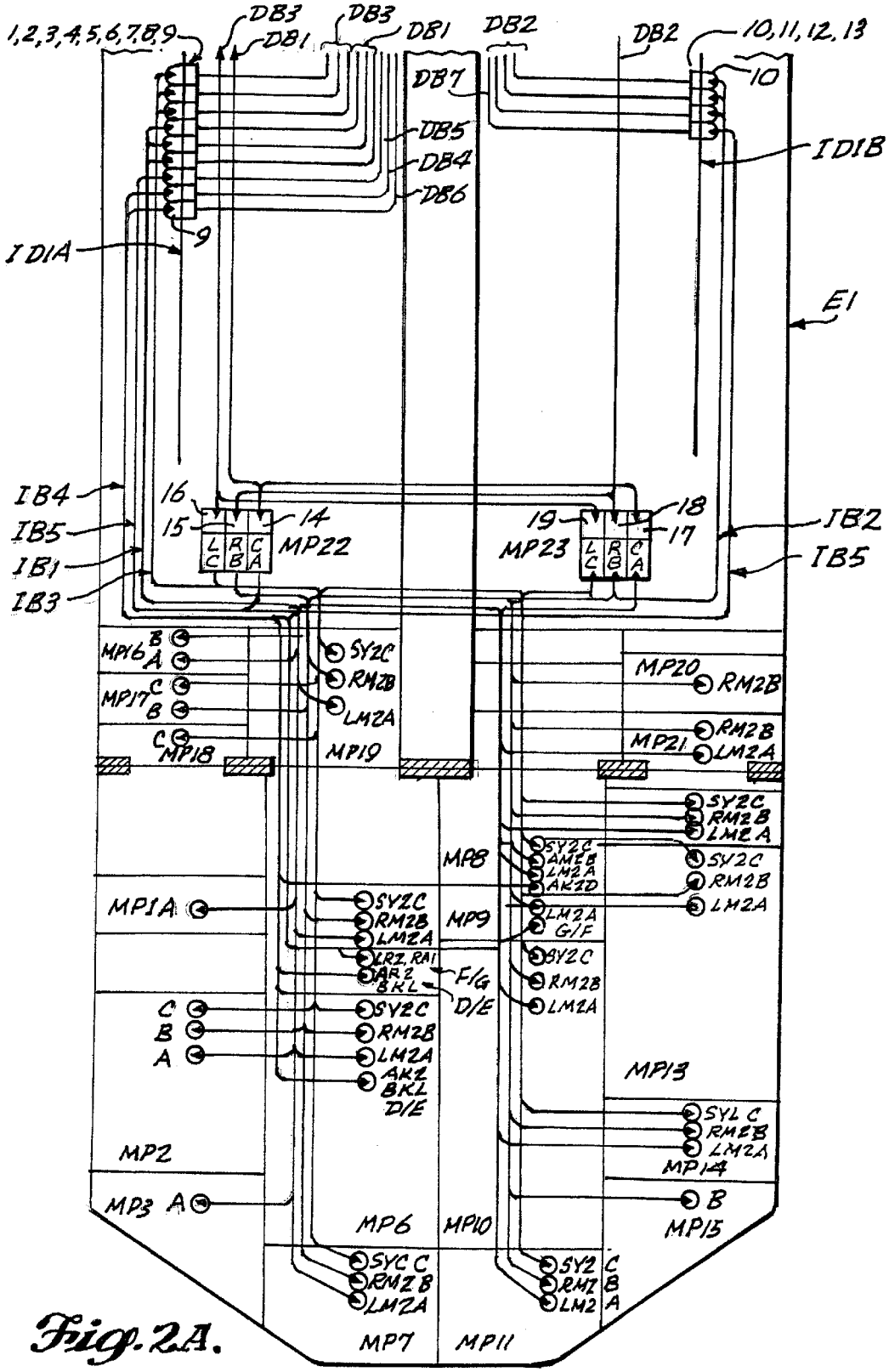
FIG. 2A is an exemplary overlay of a present system wiring interface layout for an overhead panel.

Turning now to FIG. 2A, there is seen a plural level wiring interface of the kind shown in FIG. 1 however as adapted for an overhead panel. Only the elements of the present system are shown in heavy lines.

Figure 2B:
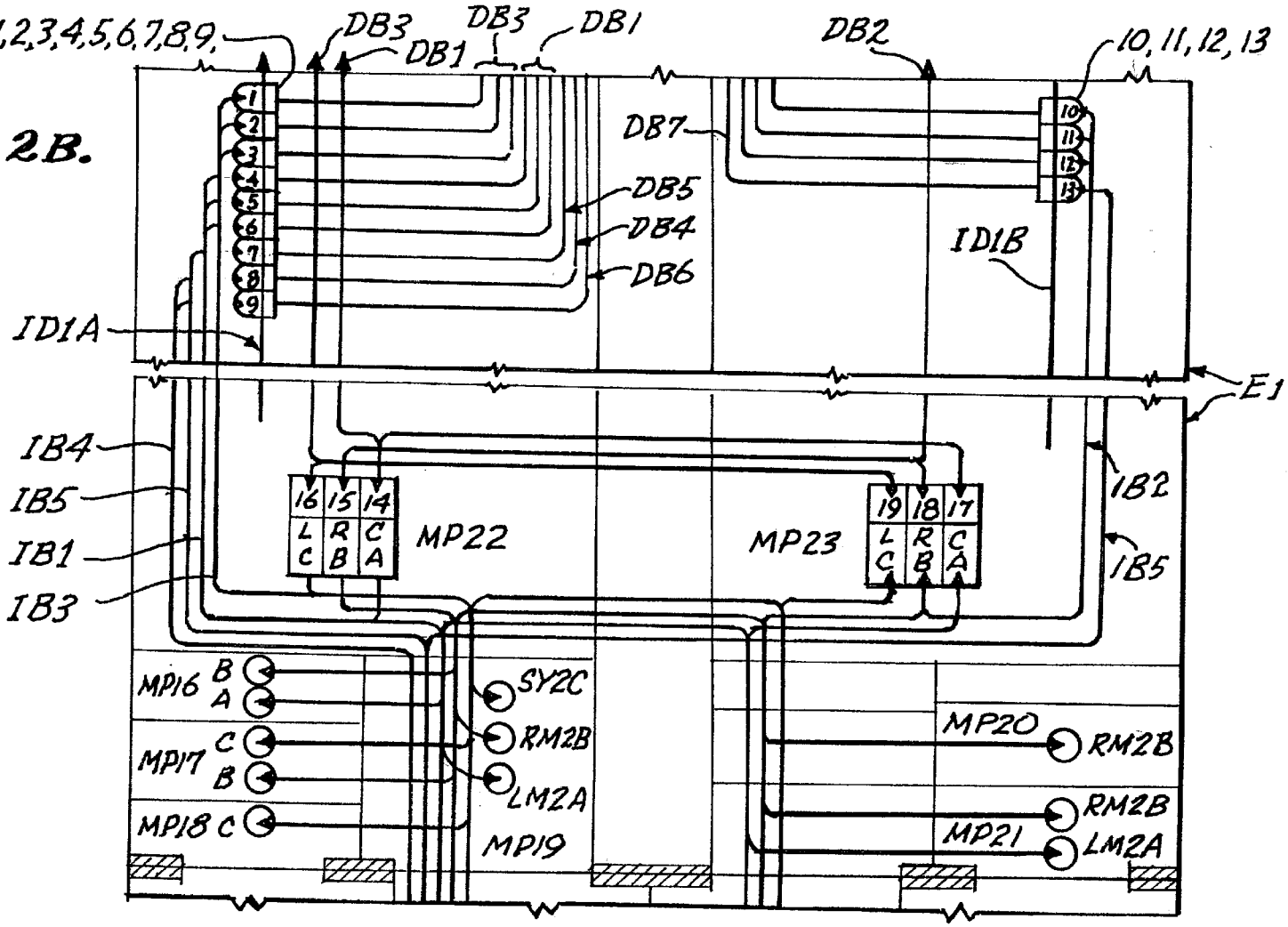
Figure 2C:
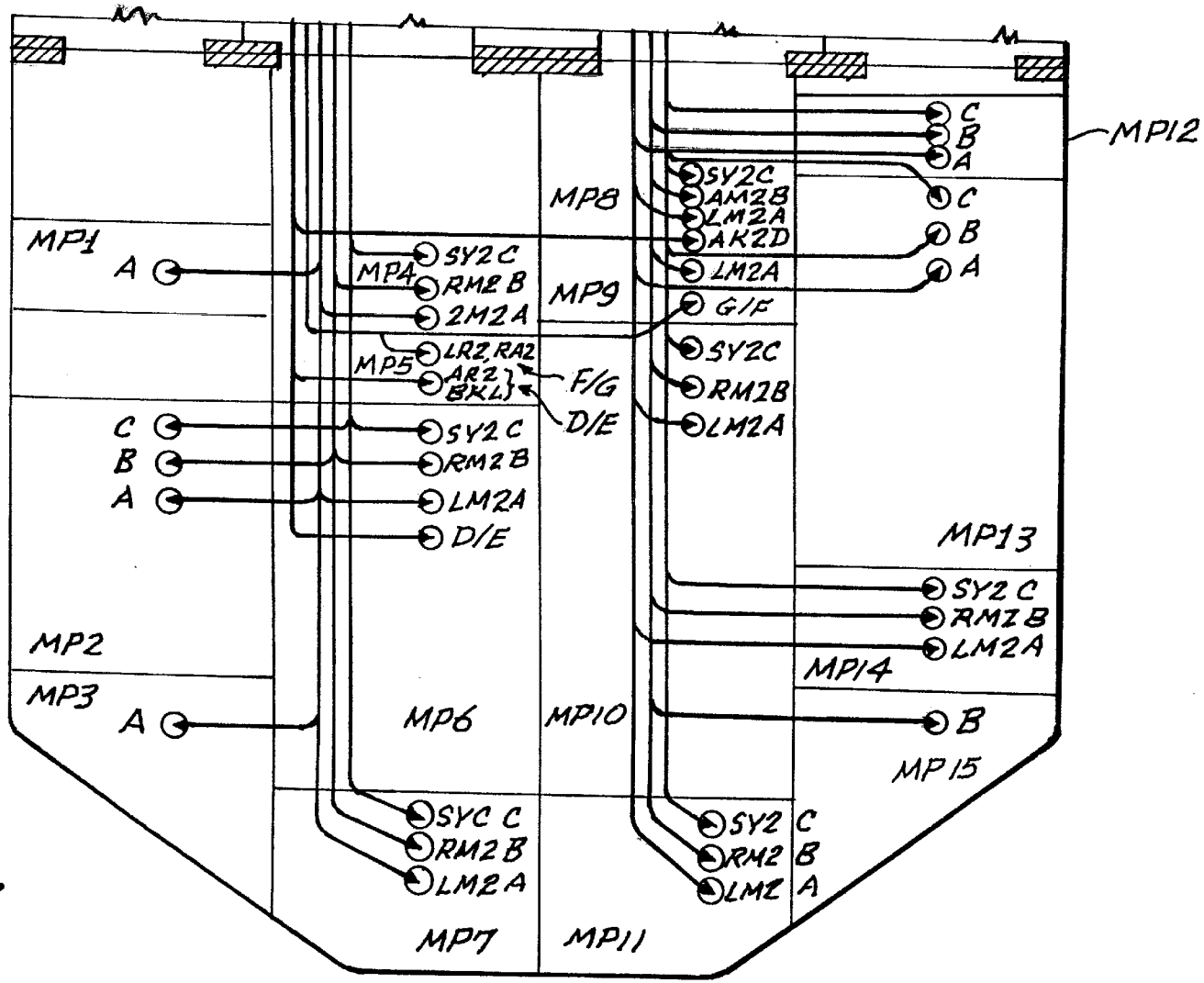

Referring to FIG. 2A, and enlarged in FIGS. 2B and 2C, giving details the following symbols are representative of the interface components:

MP1 through MP23 are modules

ID1A and ID1B are integration disconnects

IB1 through IB5 are integration wire bundles

DB1 through DB7 are distribution wire bundles

E1 is a panel assembly

A through G are dedicated separation categories at connectors

1 through 19 are connectors.

Separation categories D and E represent (in air/in space/at sea) and (on ground/at port) usage respectively, exclusive usage allows the combining of these wires into a single connector.

Separation categories F and G are redundant to categories A and B, and may be combined (provided they have protective shielding from A and B) to the first distribution breakout.

FIG. 2A (and 2B and 2C) is a detail of a complex panel, thus destination devices are not shown.

Modules MP22 and MP23 interface with both integration and distribution wire bundles.

Connectors (1,2,3), (4,5,6), and (10,11,12) are provided to handle the volume of wires.

Connectors 8 and 9 on integration disconnect ID1A are provided to separate and distribute separation category D and E wires.

Connectors 7 and 13 on integration disconnects ID1A and ID1B are provided to separate and distribute separation category A and B from F and G.

Connectors 1 through 19 also provide a panel disconnect function.

Figure 3C:
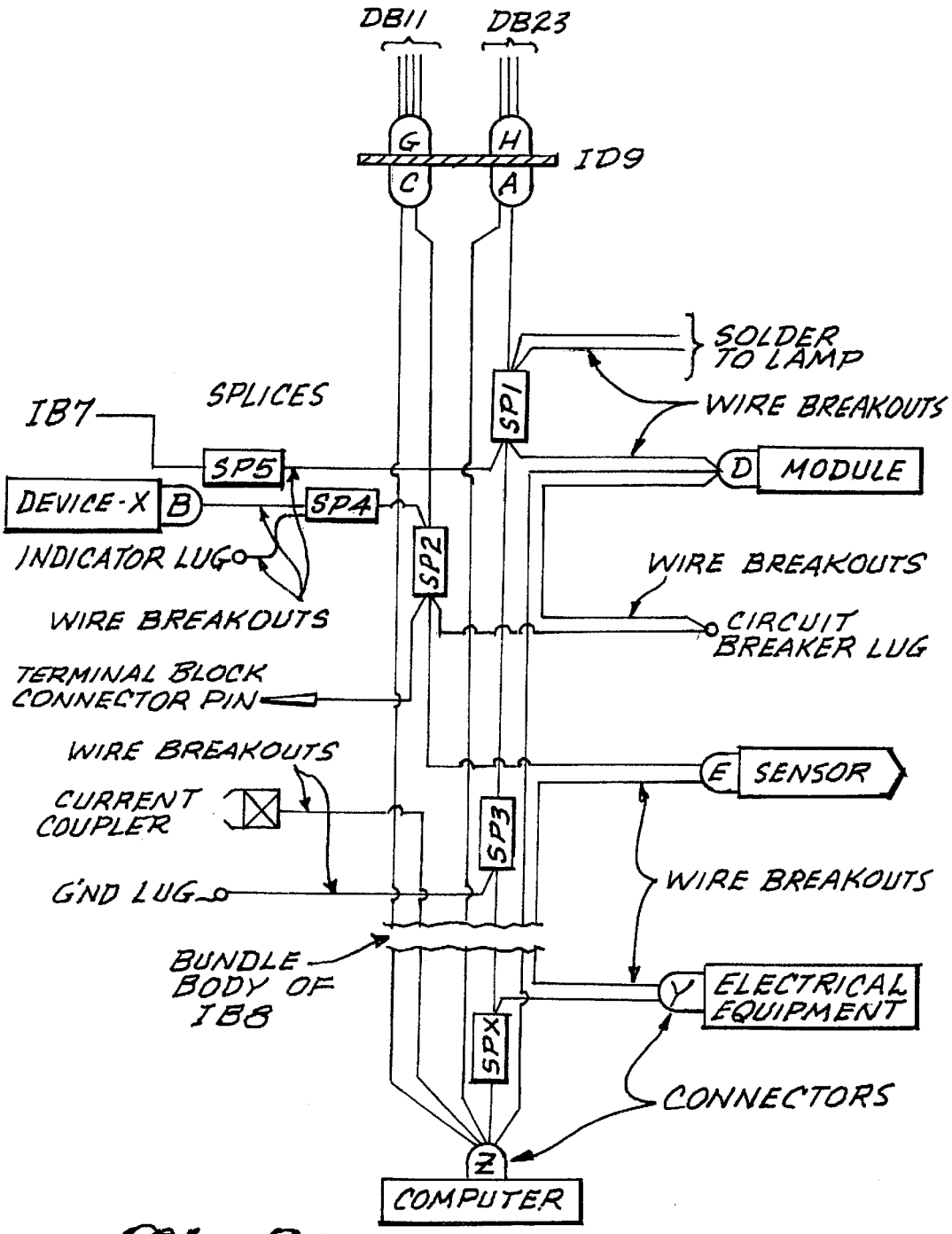
Figure 3D:
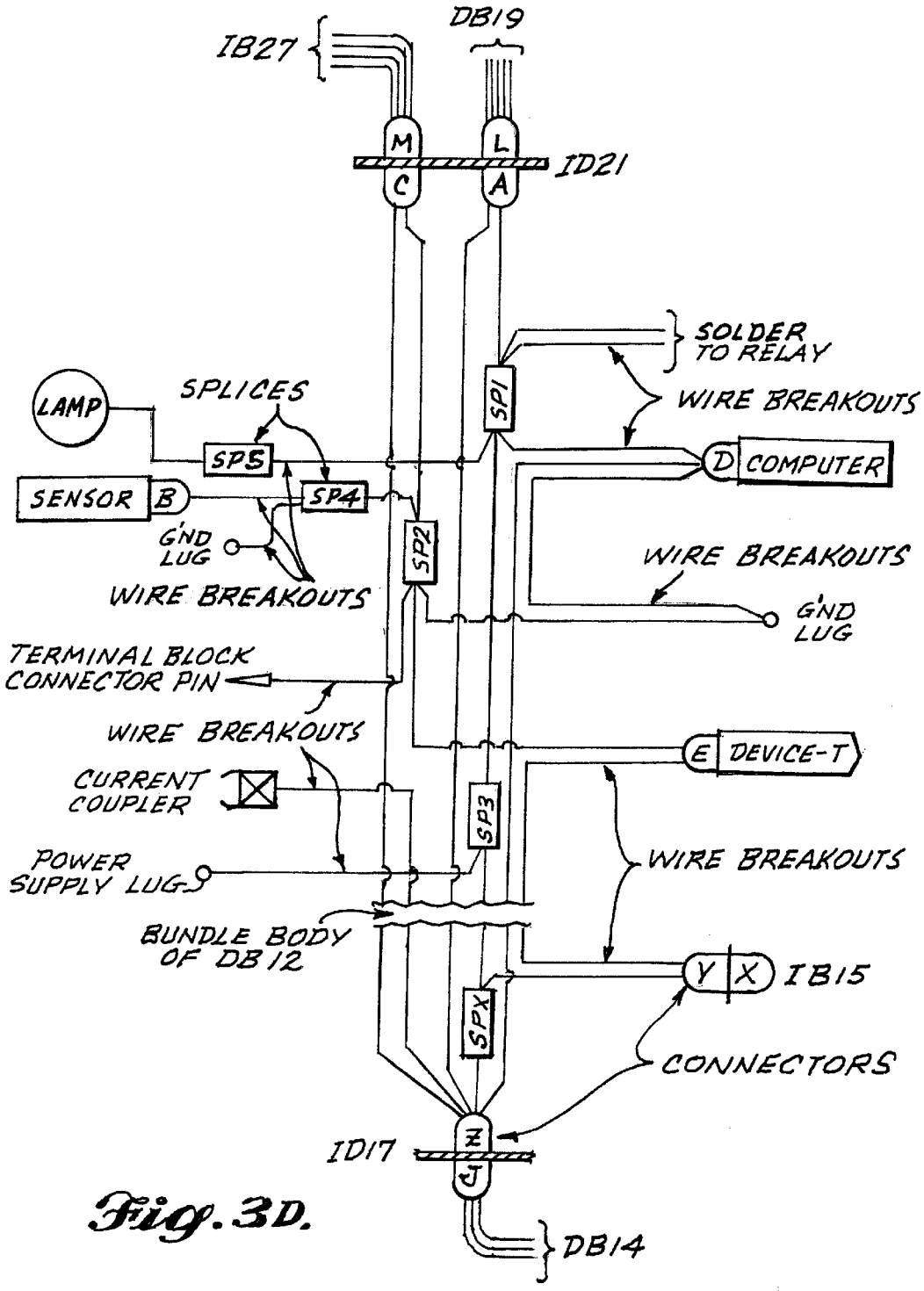

Referring to FIG. 1, FIG. 2A and FIG. 3B, integration wire bundles route wire of similar separation from various connections on devices through its bundle body to various connections on other devices and/or to connections that mate with connections or distribution wire bundles of similar separation. Integration wire bundles are used to route wire in modules, panels, equipment racks or bays, or other localized areas. An example integration wire bundle structure is represented in FIG. 3C. Distribution wire bundles route wire of similar separation from connections with integration wire bundles to connections on other integration or distribution wire bundles of similar separation and may route wire directly to devices with connections of similar separation. Distribution wire bundles are used to route wire between integration areas. An example distribution wire bundle structure is represented in FIG. 3D.

It will be further understood that the plural level wiring interface arrangements and methods herein described is not limited to the specific embodiment disclosed by way of illustration, but may assume other embodiments limited only by the scope of the appended claims.

DEFINITIONS

Separation Dedicated—Routing necessary for isolation of critical circuits to provide safety, dependability and the redundancy to prevent hazardous malfunction or simultaneous loss of equipment functions or propagation of a malfunction or failure.

Integration Disconnect—Anything that provides a method of mating one or more contacts or connectors with the function or purpose of providing integration, combining or distributing, multiple bundles without wiring between mating bundle contacts or connectors.

Bundle Body—the main portion (structure) or collective group of physical elements comprising the bundle.

Breakout—Elements comprising the bundle which exit or enter the bundle body.

What is claimed is:

1. A plural level wiring interface system for making electrical circuit connections comprising in combination:

a plurality of separation dedicated connectors, through which wire is separated and routed to prevent malfunction of a system;

a plurality of integration disconnects coupled in said wiring interface system;

a plurality of integration and distribution wire bundles including utilization of wire breakouts from a bundle body coupling between said plurality of separation dedicated connectors and said plurality of integration disconnects, and, said integrated wire bundles kept separate from each other and routed to an integration disconnect thereby preventing failure from one bundle from affecting failure in another bundle.

2. A plural level wiring interface system according to claim 1 wherein said integration disconnects have no internal wiring.

3. A plural level wiring interface according to claim 1 wherein the structure of wire breakouts comprise one or more wires entering or leaving the bundle body.

4. A method of providing a piural level wiring interface system for connecting wire bundles to eliminate wiring integration areas comprising the steps of:

providing a plurality of integration wire bundles containing wire between separation dedicated connectors and integration disconnects;

a plurality of distribution wire bundles, containing wire between integration wire bundles or including wire breakouts from the bundle body for coupling between a plurality of separation dedicated connectors and plurality of integration disconnects;

said plurality of integration wire bundles utilized to route wire in localized areas; and, said distribution wire bundles routing wire of similar separation from connections with said integration wire bundles to connections on other integration wire bundles of similar separation; and, said distribution wire bundles utilized for routing wire between integration areas.

* * * * *